United States Patent [19]

Granat

[11] Patent Number: 4,694,969

[45] Date of Patent: Sep. 22, 1987

[54] CONTAINER CLOSURE

[75] Inventor: Rodney J. Granat, Caufield, Australia

[73] Assignee: ACI Australia Limited, Melbourne, Australia

[21] Appl. No.: 672,108

[22] Filed: Nov. 15, 1984

[30] Foreign Application Priority Data

Nov. 17, 1983 [AU] Australia ..... PG2423
Jul. 16, 1984 [AU] Australia ..... PG6014

[51] Int. Cl.[4] ..... B65D 41/48

[52] U.S. Cl. ..... 215/252; 215/274; 215/295

[58] Field of Search ..... 215/274, 276, 252, 295

[56] References Cited

U.S. PATENT DOCUMENTS

| | | | |
|---|---|---|---|
| 2,449,014 | 9/1948 | Shaffer | 215/276 X |
| 3,913,771 | 10/1975 | Acton et al. | 215/274 X |
| 4,093,094 | 6/1978 | Smalley et al. | 215/276 |
| 4,473,163 | 9/1984 | Geiger | 215/276 X |
| 4,488,655 | 12/1984 | Itsubo et al. | 215/252 |
| 4,511,053 | 4/1985 | Brandes et al. | 215/252 |

*Primary Examiner*—Donald F. Norton
*Attorney, Agent, or Firm*—Ladas & Parry

[57] ABSTRACT

A two part closure for an open necked container is provided in which a cover member which may be of metal extends over the opening and a holding member which may be of plastic extends over the container neck.

16 Claims, 8 Drawing Figures

CONTAINER CLOSURE

This invention relates to a closure means for open neck containers such as jars and the like.

A large variety of open top containers of glass and other materials are known and a large number of tops, caps or other closures are known for use in conjunction with them.

Open-topped containers such as jars of the type that may be used subsequently as a drinking glass are well known in the packaging art. Such containers are used widely for the sale of food items. The jars are provided with an outwardly-flanged or thickened portion surrounding the upper edge of the jar to provide an abutment for a jar closure. Where the container is to be subsequently used as a glass, the thickened portion or flange must not be of a substantial dimension. However, this makes it difficult to provide a suitable closure.

Metal closures are known that are provided with a substantially resilient annular skirt adapted to lock beneath the jar flange. However, these closures can be difficult to remove by hand. If a tool is used the closure may be deformed and may not be re-usable. The tool may slip, causing lacerations. These dificiencies have caused a limitation to the use of containers of the type described.

For other applications jars are known having on their necks, ribs or screw threads by which closures may be connected. Metal or plastic closures can be used. In recent times resilient metal closures have been provided that move between an outer position at atmospheric pressure and an inner position when the jar is under vacuum. Such a closure is described in Australian patent specification No. 538613.

In recent times there has also developed the need to provide tamper proof closures for containers and generally these comprise plastic type closures having a tear away portion that is removed before or during opening to indicate that the container has been opened. Generally these closures will be made of a plastics material since when plastics materials are used it is relatively easy to provide a tear away ring portion.

Thus in the packaging art there are a large number of conflicting objectives. Small differences may render a product commercially acceptable or not acceptable as far as utility is concerned and may also render the product economic or non-economic. Accordingly, it is difficult to provide a container and closure arrangement that meets with a wide range of objectives of the art and yet remains economic.

The object of the present invention is to provide a new and improved container closure that provides benefits over known container closures but yet which may be manufactured economically and simply.

The present invention provides a closure for an open necked container, including a container cover member adapted to extend over and close the opening of the container and a cover holding member to hold said container cover member in sealing abutment with the opening, said cover holding member including a cover encapsulating portion extending over the peripheral ege of said cover member, retaining means extending beneath said peripheral edge to hold said cover member within said cover holding member and a depending portion including container gripping means by which said cover holding member may be retained on the container.

The closure means includes a container cover member and a cover holding member. The invention also provides a cover member for use in the closure means and a cover holding member for use therein as separate components.

The container cover member of the present invention is adapted to extend over the opening of the container and to this end is preferably a substantially planar member having a central panel portion extending over the open end of the container and a peripheral skirt portion to extend at least marginally over the container neck. Between the peripheral skirt portion and the central panel portion may be located a sealing recess in which a sealing material may be placed such that the sealing material will abut against the container neck in use to provide an hermetic seal between the container cover member and the container neck.

The container cover may be made of any suitable material. In one preferred example the container cover member is made of a substantially resilient material such as a sheet metal. Preferably the central panel portion is formed with excess material so that it may move between two positions such as a concave position, a central flat position or a convex position or any combination of them.

The cover holding member of the present invention includes a cover encapsulating portion adapted to extend over the annular peripheral edge portion of the container cover member and to hold it downwardly on the container. The cover encapsulating portion may be of any suitable configuration as will be further discussed below. The cover encapsulating portion preferably includes an upper portion adapted to extend over the upper surface of the container cover member and a depending portion adapted to extend around the outer upper rim or neck of the container. The preferred upper portion and preferred depending ring portion may be joined in any suitable manner and by any suitable means. Preferably a plurality of joining web portions are provided for this purpose to define a plurality of expansion gaps between the upper portion and the depending ring portion. In one example of the present invention there are provided four joining web portions to define four expansion gaps but it will be appreciated that any number of joining web portions and expansion gaps may be provided without departing from the spirit of the present invention.

The web portions may include a plurality of substantially perpendicular ribs that extend between the preferred upper portion and depending ring portion as above discussed.

The cover encapsulating portion of the present invention includes cover retaining means. The cover retaining means may be provided by a plurality of cover retaining projections or ribs extending inwardly from the preferred depending portion and are adapted to extend beneath the edge of the peripheral skirt portion of the container cover member as will be further discussed below.

The cover encapsulating portion may also include container gripping means. The container gripping means may be provided by one or more container gripping projections extending inwardly from the preferred depending ring portion. In a preferred embodiment a container gripping rib is provided that extends circumferentially around the inner surface of the depending ring portion and is adpated to fit within a complementary holding groove in the container neck.

Alternatively, the container gripping means may be provided by a generally sinusoidal zone of the depending portion or other resilient means to abut against the container neck. This arrangement is particularly suitable for use with containers that do not have ribs or grooves on the container neck—such as those for subsquent use as drinking glasses. The sinusoidal gripping portions may be of substantially concertina form. The abutment peaks may be provided with abutment surfaces to increase the area of contact with the container wall. The legs of the preferred sinusoidal gripping means may be set at any desirable angle. An angle of between 35°–77°, preferably between 45°–70°, has been found satisfactory. In one example an angle of 58° has been used.

The cover encapsulating portion preferably includes tamper proof means. Preferably the tamper proof means is provided by a tear strip which may be in the form of a tear strip extension to the preferred depending portion which may be severably connected thereto as a depending tear strip. The tear strip may be connected thereto by a plurality of severable connections or may be partly severed or may be connected through a weakened zone as is known in the art. The tear strip portion preferably includes an inwardly extending retaining member. The retaining member may be in the form of a retaining rib that extends annularly around the inner surface thereof. Preferably the retaining extension is adapted to extend within a retaining groove extending around the container neck as will be further discussed below.

The tear strip portion may include a tab by which it may be gripped and be severed manually from the depending ring portion.

The container to which the closure means of the present invention is applied may include an annular holding groove and an annular retaining groove defined between a plurality of ribs extending around the container neck. Those ribs may take the form of helical ribs if it is desired that the closure means of the present invention be removed by a screw threaded arrangement. In the preferred form of the present invention the ribs are annular ribs from which the closure means may be removed as will be further discussed below.

The closure means of the present invention preferably includes cover distortion means whereby to assist in removing the cover from the container. To this end, the cover distortion means may include one or more distortion members on the inside surface of the depending ring portion and one or more complementary distortion members on the container neck whereby together to push a portion of the ring portion outwardly as the cover is turned. The distortion members may be provided by the cover gripping projections if desired and are preferably provided by a plurality of lugs adapted to perform both functions as further explained below.

The container may include guide means complementary to the distortion members and for example may be in the form of ramps to push the ring portion outwardly when contacted by a distortion member. Preferably as fully discussed below, the spacing between the distortion members is different to the spacing between guide members so that only one contact is made at any position.

The invention will now be further described with reference to the accompanying drawings in which.

Figure 1:
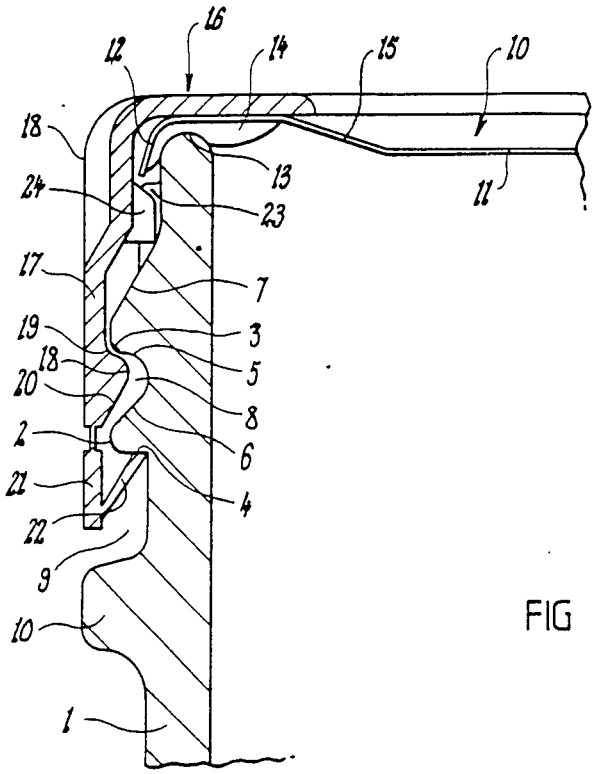
FIG. 1 is a cross-sectional view of one form of container and closure.
Figure 2:
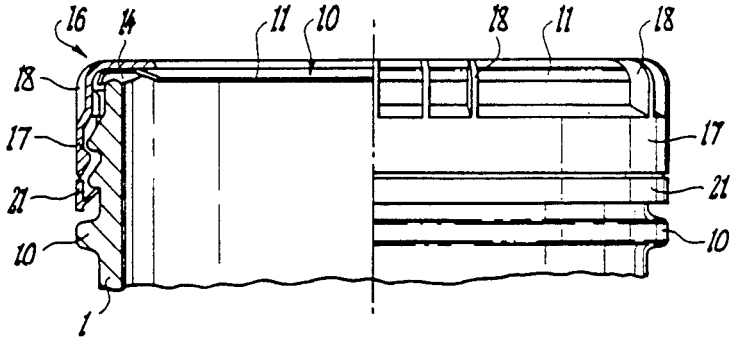
FIG. 2 shows the container and closure of claim 1 in partial cross-section.
Figure 3:
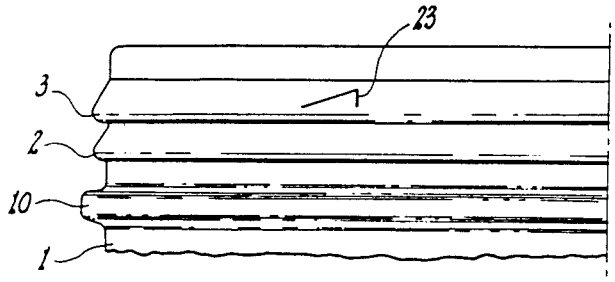
FIG. 3 shows the container neck of FIGS. 1 and 2.

In reference to the container and closure shown in FIGS. 1 to 3, there is shown a container neck 1. The container neck of this embodiment includes substantially annular ribs 2 and 3. The ribs 2 and 3 preferably each have a retaining shoulder 4 and 5 respectively and a ramp portion 6 and 7 respectively. The preferred ramp portions are uppermost and the preferred shoulder portions below for a purpose that will be more fully described below. Between the preferred shoulder portion 5 of rib 3 and ramp portion 6 of rib 2 is defined a holding groove 8 and below the shoulder portion 4 of rib 2 is defined the retaining groove 9. An annular rib 10 may also be provided on the container neck if desired.

Preferably the container includes on its neck 1 one or more guide members preferably above the ramp portion 7. Preferably a pair of guide members 23 are provided equally spaced around the container neck, although it will be appreciated that any suitable number of guide members 23 may be provided.

The container cover member shown generally at 10 includes a central panel portion 11 which is shown in a preferred concave position. The container cover members includes a peripheral skirt portion shown at 12 that extends over the upper neck portion of the container at 13. Sealing material as shown at 14 may be included to provide an hermetic seal between the container cover member and the container neck as will be appreciated by those skilled in the art.

The central panel portion 10 may include an intermediate sloped annular portion as at 15.

The cover holding member as above described has a cover encapsulating portion shown generally at 16 and a depending ring portion at 17. The cover encapsulating portion may take any suitable configuration but is preferably provided by an annular portion as shown. The depending ring portion may be continuous or discontinuous and preferably is connected to the encapsulating portion 16 through a plurality of ribs shown at 18 which may be established in sets or groups as shown in the drawings. The depending ring portion 17 may include one or more cover gripping projections. Preferably a plurality of lugs 24 are provided for this purpose, located on the inner surface of the depending ring and adapted to abut against the edge of the peripheral skirt portion 12 thereto to hold the container cover member within the cover holding member. In one example three lugs 24 are provided equally spaced around the ring portion 17 although it will be appreciated that any suitable member may be provided. Preferably a different number of lugs 24 is provided to the number of guide members 23, and so that the spacing is different, for a purpose fully described below.

The depending ring portion 17 includes a container gripping rib 18 which preferably has an upwardly facing shoulder portion 19 and a ramp portion 20.

The embodiment shown in FIGS. 1 to 3 includes a tear strip 21 including a retaining extension 22.

It will be appreciated that in use the container cover member 11 is held within the cover holding member by the combined action of the encapsulating portion 16 and lugs 24. The cover member 10 may be fitted therein by an easy flexing out of the depending ring portion 17. By this means the central panel portion 11 is free from movement up and down between a concave and convex position and therefore may be used to package materials within the container under vacuum where the central panel portion will be pulled into its concave position and when opened move upwardly and preferably with an audible click or other sound to indicate to the user that the package was under vacuum. This is a most important advantage that is not available in prior art plastic tamper proof closures.

In use the closure may be placed downwardly on the container neck. The preferred upwardly sloping extension 22 will ride over the ramp 7 forcing the tear away strip outwardly but not severing it. Similarly, the ramp portion 20 of rib 18 will meet the ramp portion 7 of rib 3 to force the depending ring portion 17 outwardly. The ramp portion 7 will also assist in the projection 22 riding over rib 2. But it will be seen that when the rib 18 is in position within the groove 8 the shoulder portion 19 of the rib 18 will abut against the shoulder 5 of rib 3 to hold the parts together unless the depending ring portion 17 is pulled outwardly. Similarly the projection 22 abuts against the shoulder 4 of rib 2 to hold the tear away portion in position until removed. In one example the lower portion of the tear away strip 21 may be closely adjacent the rib 10 of the container so that it is difficult for persons to apply a grip beneath the tear away portion 21.

In use the tear away portion 21 should first be removed before the closure can be removed from the container and this may be achieved by any suitable method. The tear away portion may be retained in its moved position or be totally removable as will be appreciated by those skilled in the art. Once the tear away portion has been removed it is possible to rotate the closure. This means that a lug 24 will meet a complementary guide member 23 which will push that portion of the ring portion 17 outwardly breaking the contact between the shoulder 19 and shoulder 5 in that zone. Thus the closure may be pulled upwardly and removed from the container neck. The closure means may be reapplied to the container by pushing it downwardly as before. It will be seen that by ensuring that the spacing between lugs 24 and guide members 23 is different, only one lug will contact a guide member at any position thus to ensure that the ring portion 17 will be pushed out at one zone only. Preferably the cover holding member is of deformable material and preferably a plastics material as known in the art.

Figure 4:
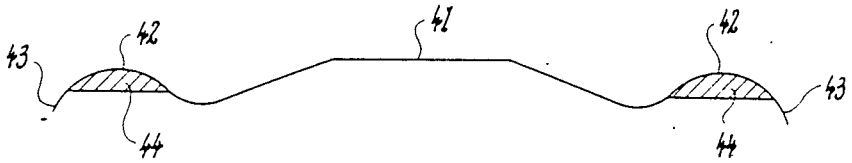
FIG. 4 shows in cross-section a container cover member.

In the closure of the invention illustrated in FIGS. 4–8 of the drawings, the cover member thereof is shown in FIG. 4 while the cover-holding member is shown in FIGS. 5–8. As in the enclosures of the closure of FIGS. 1 and 2, the cover-holding member has a cover encapsulating portion shown generally at 26 and comprised of an inner pull ring 27 and an outer ring 28. A hinge portion is shown at 29 and a pair of connecting portions at 30 and 30'. The outer ring portion 28 may include an indentation to provide an access means at 33. The depending ring portion is shown generally at 25 and includes narrow ring sections 31 from each of which depends a respective gripping member 35; the depending ring portion being completed by web portions 32 which join successive sections 31 and their gripping members 35.

Cover gripping ribs are shown at 34 and are preferrably located beneath each joining web portion 32.

The gripping members are of sinusoidal, i.e. undulated, or concerntina form and are located beneath the expanded grap shown at 36.

Figure 8:
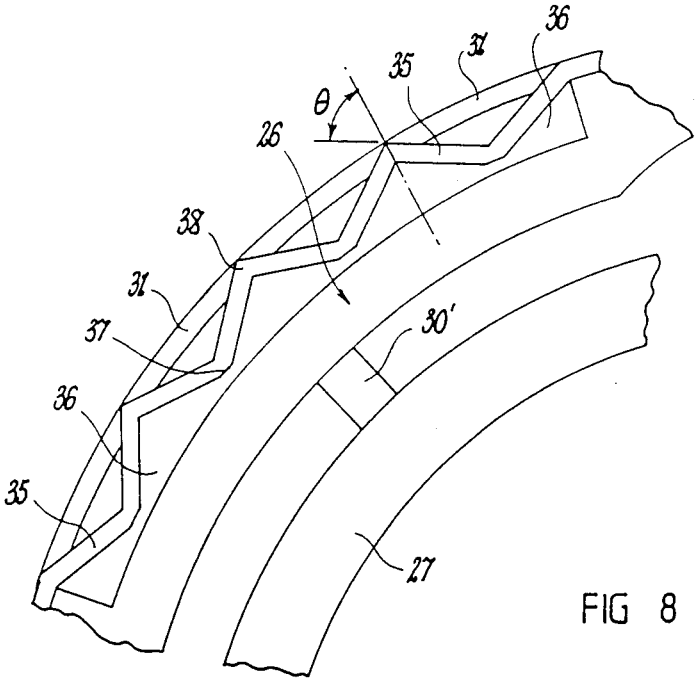
FIG. 8 is an expanded view of a portion of the cover holding member of FIG. 6.
Figure 5:
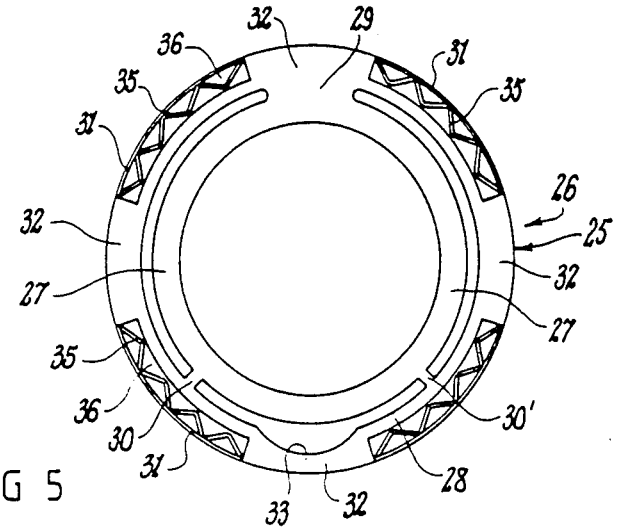
FIG. 5 shows in plan an alternative cover holding member.
Figure 6:
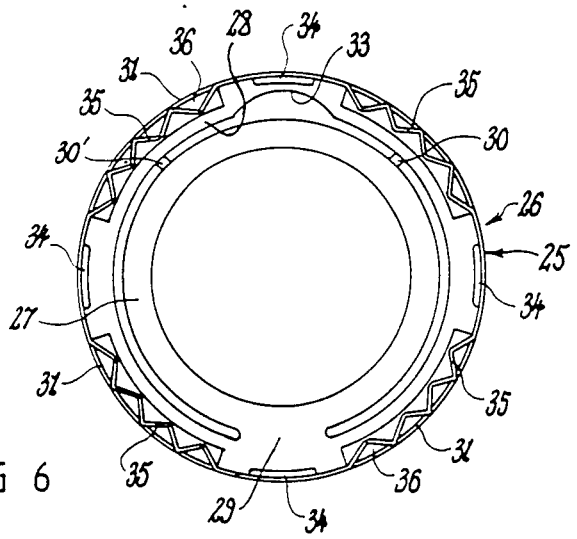
FIG. 6 is an inverse plan of the cover holding member of FIG. 5.
Figure 7:
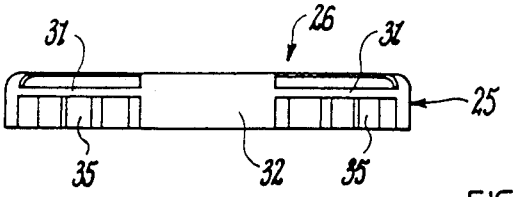
FIG. 7 is an elevation of the cover holding member of FIGS. 5 and 6.

FIG. 8 shows an expanded view of the sinusoidal i.e. undulated gripping member showing flattened contact portion 37 and connecting portion 38 whereby it is connected to the ring 31. The angle $\theta$ as shown in the drawings is the angle referred to throughout this description. It will be seen that the container cover member is adapted to be placed over the preferred jar so that the sealing composition in the sealing recess 42 is located over the jar edge. The preferred flange 43 extends outwardly of the container edge.

The cover holding member is adapted to extend over the cover member. The cover member is adapted to fit within the cover holding member with the flange 43 located above the preferred cover gripping ribs 34 so that the cover member is retained within the cover holding member but removable therefrom as may be desired.

The gripping members 35 are adapted to abut against the container wall at points 37 to cause an outwardly extending expansion of the concertina members 35 and the associated ring 31 thus to create an inwardly directed returning force firmly to hold the cover holding member to the container wall as will readily be appreciated by those skilled in the art.

As will be apparent to those skilled in the art, the closure of FIGS. 4 to 8 is intended to be retained on a container under a vacuum, generated in the container by retorting or the like, and retaining the cover member in sealing relation on the container. To remove the closure, a user grips ring 27 at indentation 33 and lifts ring 27, with pivoting thereof about hinge 29, and rupture of connecting portions 30, 30'. Ring 27 is then pulled away from the container, with a resultant force being applied to the cover member by and being concentrated at the rib 34 adjacent hinge 29. Concentration of that force lifts the cover member adjacent hinge 29 to break the vacuum and thereby enable removal of the closure. However, the closure can be reapplied to the container and, while it then will not be held under vacuum, it will be releasably held on the container by the resilient action of gripping members 35 engaging the peripheral wall of the container adjacent the rim of the latter.

Thus this embodiment provides a simple and inexpensive closure means for a jar-like container that can be readily removed from and replaced onto the container. It can accommodate a 'pop top' feature. It does not require the use of an opening tool.

FIG. 4 shows an example of an alternative container cover portion for use in the present invention. A central panel is shown at 41. 42 shows a sealing recess and 43 shows an outwardly flanged portion. 44 shows sealing composition within the recess 42.

In accordance with the present invention there is provided a two piece closure means where the central panel may be made of metal to provide the advantages above described and where the holding member may be made of plastics material to provide the advantages in the construction of a tamper proof closure. Thus by use of the present invention it is possible to obtain the advantages of a metal closure and the advantages of a plastics closure without substantially increasing the cost.

It will be appreciated that many variations and modifications may be made to the above described construction and arrangement of parts without departing from the ambit of the present invention.

We claim:

1. A closure for an open necked container of the type having a sealing rim defining a container opening and at least one external annular rib spaced from the said rim for non-threaded engagement by said closure; said closure includng a container cover member adapted to extend over and close the opening of the container, with a peripheral edge of the cover member extending marginally beyond the container sealing rim, and a resilient cover holding member integrally moulded from plastics material, said cover holding member being adapted to hold said container cover member in sealing abutment with the container rim and including a cover encapsulating portion extending radially over said peripheral edge, a depending portion entending below said peripheral edge, at least one annular retaining rib projecting radially inwardly from said depending portion and spaced from said encapsulating portion for non-threaded engagement below said annular rib of the container, and retaining means extending beneath said peripheral edge to hold said cover member within said cover holding member; said retaining means comprising a plurality of lugs spaced circumferentially around, and projecting radially inwardly from, said depending portions; said lugs each being spaced from said encapsulating portion and said cover holding member being operable such that, on rotation of said cover holding member on a container, one of said lugs engages an axially inclined ramp surface defined by the container, said cover holding member twists out of a co-axial relationship with the container opening to initiate disengagement of said at least one retaining rib from the at least one annular rib of the container and simultaneously causes said one lug to locally engage said peripheral edge and initiate lifting of said container cover member from the container rim.

2. A closure as claimed in claim 1 wherein said cover member includes an annular sealing recess containing sealing material adapted to abut against the container rim for sealing therewith.

3. A closure as claimed in claim 1, wherein there is a plurality of said retaining ribs located on the inner surface of said depending portion.

4. A closure as claimed in claim 1, wherein said container cover member has a central panel portion within said peripheral edge thereof, said panel portion being of flexible construction and thereby responsive to a fluid pressure differential acting on upper and lower surfaces thereof so as to be movable between respective positions in which said upper surface is convex and concave.

5. A closure as claimed in claim 4, wherein said container cover member defines an annular recess, a sealant material being provided in said annular recess and adapted to provide a seal between said cover member and a sealing rim of the container opening.

6. A closure as claimed in claim 1, further including an annular tear strip severably connected to the cover holding member at an edge of said depending portion remote from said encapsulating portion; said tear strip being adapted to engage under a corresponding rib defined on the container neck and thereby to separate from said cover holding member.

7. A closure as claimed in claim 6, wherein said tear strip has a frusto-conical portion thereof which extends radially inwardly with respect to said depending portion and axially toward said depending portion, said tear strip being adapted to engage under said corresponding rib by resilient deformation of said frusto-conical portion.

8. A closure for an open necked container of the type having a sealing rim defining a container opening; said closure including a container cover member adapted to extend over and close the opening of the container, with a peripheral edge of the cover member extending marginally beyond the container sealing rim, and a resilient cover holding member integrally moulded from plastics material; said cover holding member being adapted to hold said container cover member in sealing abutment with the container rim and including a cover encapsulating portion extending radially over said peripheral edge, a depending portion extending below said peripheral edge, and retaining means extending beneath said peripheral edge to hold said cover member within said cover holding member; said retaining means comprising a plurality of lugs spaced circumferentially around, and projecting radially inwardly from, said depending portion; said depending portion of the cover holding member defining retaining means for releaseably gripping the container, said gripping means comprising angularly spaced regions of undulated form, with each said region defining a plurality of axially extending angularly spaced container gripping surfaces.

9. A closure according to claim 8, wherein said cover holding member is adapted to be tilted out of a co-axial relationship with the container opening to cause one of said lugs to locally engage said peripheral edge and thereby initiate lifting of said container cover member from the container rim.

10. A closure according to claim 9, wherein said encapsulating portion of the cover holding member includes an inner ring member hingedly connected to an outer ring member, whereby a force by which said cover holding member is so tilted can be applied by lifting and pulling said inner ring.

11. A closure as claimed in claim 8, wherein said container cover member is adapted to seal the container under the action of a fluid pressure differential, resulting from a reduced pressure in said container, acting on upper and lower surfaces of said container cover member; and said cover holding member being adapted to be tilted out of co-axial relationship with the container opening to cause one of said lugs to locally engage said peripheral edge and thereby initiate lifting of said container cover member from the container against the action of said pressure differential; the closure being adapted to reclose the container opening after such removal and to be releaseably retained in sealing engagement with said opening, in the absence of such pressure differential, by the action of said gripping means gripping said container.

12. A closure as claimed in claim 11, wherein said encapsulating portion of the cover holding member is an outer ring member; the cover holding member including an inner ring member within, and hingedly connected to, said outer ring member whereby a force by which said cover holding member is tilted can be applied by lifting and pulling said inner ring member.

13. A closure as claimed in claim 8, wherein each of said gripping means is defined by a plurality of circumferentially extending legs in end to end relation, successive said legs being at an angle of between 45° and 70° to provide said regions of undulated form.

14. A closure as claimed in claim 13, wherein said angle is about 50°.

15. A closure for an open necked container of the type having a sealing rim defining a container opening; said closure including a container cover member adapted to extend over and close the opening of the container, with a peripheral edge of the cover member extending marginally beyond the container sealing rim, and a resilient cover holding member integrally moulded from plastics material; said cover holding member being adapted to hold said container cover member in sealing abutment with the container rim and including a cover encapsulating portion extending radially over said peripheral edge, a depending portion extending below said peripheral edge, and retaining means extending beneath said peripheral edge to hold said cover member within said cover holding member; said retaining means comprising a plurality of lugs spaced circumferentially around, and projecting radially inwardly from, said depending portion; said depending portion of the cover holding member defining retaining means for releasably gripping the container and comprising angularly spaced regions undulated form, with each of said regions defining a plurality of of axially extending angularly spaced container gripping surfaces.

16. A closure for an open necked container of the type having a sealing rim defining a container opening; said closure including a container cover member adapted to extend over and close the opening of the container, with a peripheral edge of the cover member extending marginally beyond the container sealing rim, and a resilient cover holding member integrally moulded from plastics material; said cover holding member being adapted to hold said container cover member in sealing abutment with the container rim and including a cover encapsulating portion extending radially over said peripheral edge, a depending portion extending below said peripheral edge to hold said cover member within said cover holding member; said retaining means comprising a plurality of lugs spaced circumferentially around, and projecting radially inwardly from, said depending portion; said depending portion of the cover holding member defining retaining means for releaseably gripping the container and comprising angularly spaced regions of sinusoidal form, with each of said regions defining a plurality of axially extending angularly spaced container gripping surfaces.

* * * * *